United States Patent [19]

Donaldson et al.

[11] Patent Number: 4,947,608

[45] Date of Patent: Aug. 14, 1990

[54] WATERTIGHT FASTENER

[75] Inventors: Barry G. Donaldson, Yorktown, N.Y.; Joseph H. Newman, West Orange, N.J.

[73] Assignee: Tishman Research Corporation, New York, N.Y.

[21] Appl. No.: 395,024

[22] Filed: Aug. 17, 1989

Related U.S. Application Data

[63] Continuation of Ser. No. 159,108, Feb. 23, 1988.

[51] Int. Cl.[5] ..... E04B 1/38

[52] U.S. Cl. ..... 52/509; 52/35; 52/506; 52/512

[58] Field of Search ..... 52/506, 512, 391, 384, 52/385, 386, 387, 389, 378, 379, 235, 34, 35, 509; 248/225.1

[56] References Cited

U.S. PATENT DOCUMENTS

| | | | |
|---|---|---|---|
| 3,342,005 | 9/1967 | Rickards et al. . | |
| 3,478,480 | 11/1969 | Swenson . | |
| 3,479,778 | 11/1969 | Johnson | 52/35 |
| 3,605,352 | 9/1971 | Ruggles et al. | 52/35 |
| 4,262,464 | 4/1981 | Ludowici . | |

FOREIGN PATENT DOCUMENTS

| | | | |
|---|---|---|---|
| 1476981 | 4/1967 | France | 52/509 |
| 2553454 | 4/1985 | France | 52/509 |

*Primary Examiner*—Michael Safavi

*Attorney, Agent, or Firm*—Amster, Rothstein & Ebenstein

[57] ABSTRACT

A watertight fastener for mounting a peripherally grooved prefabricated bathtub surround panel on a wall. The fastener includes a rigid support and a resilient seal. The support has a mounting portion adapted to be secured to the wall, and a surround-receiving portion adapted to enter the peripheral groove of the surround panel and defining adjacent the free end thereof an aperture extending at least partially therethrough. The seal has an elongate body portion and a sealing portion. The body portion is adopted to enter the peripheral groove of the surround panel with the surround-receiving portion, has a serrated front surface, and defines a transversely-extending plug resiliently retained by the aperture. The sealing portion is adapted to extend intermediate the surround and an adjacent surface to form a watertight seal therebetween.

10 Claims, 5 Drawing Sheets

WATERTIGHT FASTENER

This is a continuation of co-pending application Ser. No. 07/ 159,108 filed on Feb. 23, 1988.

BACKGROUND OF THE INVENTION

The present invention relates to watertight fasteners, and more particularly to a watertight fastener for mounting a prefabricated bathtub surround on a wall.

A panel of a prefabricated bathtub surround is typically formed of an outer stone or stone like veneer and an inner substrate, the latter being used in conjunction with a fastener to secure the outer veneer to the wall (or more particularly to a metal stud of the wall) over the bathtub. Such a fastener must serve two paramount functions. First, it must provide support for the surround panels so that the surround panels are held in place on the wall over the bathtub and in proper relationship to one another. Second, it must provide a fluid-tight seal which precludes water from attacking the wall by passing between the surround and the bathtub or between the adjacent panels forming the surround. If water succeeds in reaching the wall, the wall, the metal stud thereof and/or the inner substrate of the surround panels may over time be eroded to the point where it can no longer provide its designated structural support function.

The known fasteners for mounting the surround panels on the wall were not entirely satisfactory in use. Prior art fasteners tend to concentrate on the fastening function, leaving to a separate sealing element the sealing function. This increased the difficulty and cost of construction as at the work site two separate elements had to be properly located and then maintained in place as the surround was mounted. Second, the fasteners provided adequate support for the surround panel against displacement in one direction, but not against displacement in the opposite direction. For example, the fasteners providing vertical support for the surround panel did not prevent or resist upward movement of the surround panel relative to the fastener. Third, if the portion of the fastener entering an opening in the surround panel was of sufficient thickness to fill the opening and thereby prevent movement of the surround panel towards and away from the wall, then it was difficult to fit the surround panel opening over the fastener portion. On the other hand, if the surround panel opening was large enough to easily receive the fastener portion, then the fastener portion was unable to provide stability.

The prior art sealing elements were not entirely satisfactory in use either. They provided no support function other than that irreducible minimum which is provided by any element which is capable of only finite compression; for the purposes of the present application, such an element is not considered as providing any support function. They had to be disposed in place separate from the fasteners and had to be maintained in such positions against dislodgement by the surround being put into its mounted position.

Accordingly, it is an object of the present invention to provide a watertight fastener which combines the functions of a fastener and a sealing element while acting as a one-piece unit.

Another object is to provide such a fastener which obviates the need for a separate sealing element.

A further object is to provide such a fastener which not only precludes movement of a surround panel in one direction, but also resists displacement of the surround panel in the opposite direction relative to the fastener.

It is also an object of the present invention to provide such a fastener which easily receives the surround panel and yet provides resistance to displacement of the surround panel towards or from the wall.

It is another object to provide such a fastener which is easy and economical to manufacture and use.

SUMMARY OF THE INVENTION

The above and related objects of the present invention are attained by using a watertight fastener for mounting a prefabricated surround panel on a wall, the surround panel having a peripheral groove. The fastener comprises a rigid support member and a resilient seal member. The rigid support member has in turn a mounting portion and a surround-receiving portion. The mounting portion is adapted to be secured to the wall, and the surround-receiving portion is adapted to enter the peripheral groove of the surround panel. The resilient seal member has in turn an elongate body and a sealing portion. The body portion is adapted to enter the peripheral groove of the surround panel with the surround-receiving portion of the support member, and the sealing portion is adapted to extend intermediate the surround panel and an adjacent surface to form a watertight seal therebetween.

In a preferred embodiment, the body portion of the seal member has a first surface abutting a surface of the surround-receiving portion of the support member and a second surface abutting a surface of the peripheral groove of the surround panel when the peripheral groove of the surround panel is received by the surround-receiving portion. The body portion of the seal member further has a serrated front surface adapted to abut a front surface of the peripheral groove of the surround panel to form a watertight seal therebetween. The surround-receiving portion of the support member and the body portion of said seal member defines means for joining the two members for movement as a unit. More particularly, the joining means comprises one of the surround-receiving portion and the body portion defining adjacent the free end thereof an aperture extending at least partially therethrough, and the other of the surround-receiving portion and the body portion defining adjacent the free end thereof a transversely-extending plug resiliently retained in the aperture, the plug and the aperture being configured and dimensioned to interlock. Preferably, the surround-receiving portion defines the aperture and the body portion defines the plug.

Preferably the body portion extends adjacent to and substantially the length of the surround-receiving portion, and the support member defines an open-ended chamber adapted to receive a portion of the surround panel. The sealing portion extends transverse to and away from the wall, and optionally also toward the wall.

The fastener of the present invention has three basic configurations, each particularly useful for a given application. First is a watertight support fastener for mounting a prefabricated surround panel on a wall above a fixture, the surround panel having a peripheral groove. The fastener comprises a rigid support member of substantially U-shape having a mounting portion adapted to be secured to the wall, a surround-receiving portion adapted to enter the peripheral groove of the surround panel, and a base connecting the mounting portion and the surround-receiving portion. The base, the mounting portion and the surround-receiving portion define an open-top chamber adapted to receive a portion of the surround panel. The fastener further comprises a resilient seal member having an elongate body portion and a sealing portion. The body portion is adapted to enter the peripheral groove of the surround panel with the surround-receiving portion of the support member. The sealing portion is adapted to extend intermediate the surround panel and the fixture to form a watertight seal therebetween.

Second is a watertight butt joint fastener for mounting a horizontally aligned and laterally adjacent pair of prefabricated surround panels on a wall to form a butt joint, each surround panel having a peripheral groove. The fastener comprises a rigid support member having a substantially H-shape defined by a pair of horizontally aligned and laterally adjacent mounting portions adapted to be secured to the wall, a pair of horizontally aligned and laterally adjacent surround-receiving portions adapted to enter the peripheral grooves of different ones of the surround panels, and a base connecting the mounting portions and surround-receiving portions. The base, one of the mounting portions and one of the surround-receiving portions to one side of the base define an open-ended chamber to receive a portion of one of the surround panels, and the base, the other of the mounting portions and the other of the surround-receiving portions to the other side of the base define another open-ended chamber to receive a portion of the other of the surround panels. The fastener further comprises a resilient seal member having a T-shape defined by an elongate body portion and a sealing portion. The body portion extends substantially the length of and in contact with an adjacent side of the surround-receiving portions of the support member, the free ends of the body portion and the adjacent surround-receiving portions being adapted to enter the peripheral grooves of different surround panels. The sealing portion is adapted to extend transversely to the body portion between the pair of surround panels to form a watertight seal therebetween.

Third is a watertight corner fastener for mounting a pair of prefabricated surround panels on the walls of a corner with the surround panels being mutually disposed at a right angle to form a corner joint, each surround panel having a peripheral groove. The fastener comprises a rigid support member having a mounting portion and a surround-receiving portion. The mounting portion is adapted to be secured to the wall, and the surround-receiving portion has a substantially L-shape and has free ends adapted to enter the peripheral grooves of different surround panels. The fastener further comprises a resilient seal member having an elongate body portion and a sealing portion. The body portion has substantially an L-shape and extends substantially the length of and in contact with an adjacent side of the surround-receiving portions of the support member. The free ends of the body portion and the adjacent surround-receiving portions are adapted to enter the peripheral grooves of different surround panels. The sealing portion are adapted to extend diagonally outwardly from the vertex of the body portion between the pair of surrounds to form a watertight seal therebetween.

The present invention further encompasses, in combination on a wall, a prefabricated surround panel defining at the base thereof intermediate the front and back thereof a peripherally-opening groove, and a watertight fastener mounting the surround panel on the wall. The fastener comprises a rigid support member and a resilient seal member. The rigid support member has in turn a mounting portion and a surround-receiving portion. The mounting portion is secured to the wall, and the surround-receiving portion extends within the peripheral groove of the surround panel. The resilient seal member has in turn an elongate body portion and a sealing portion. The body portion extends within the peripheral groove of the surround panel with the surround-receiving portion, and the sealing portion extends intermediate the surround panel and an adjacent surface to form a watertight seal therebetween.

BRIEF DESCRIPTION OF THE DRAWING

The above brief description as well as further objects and features of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
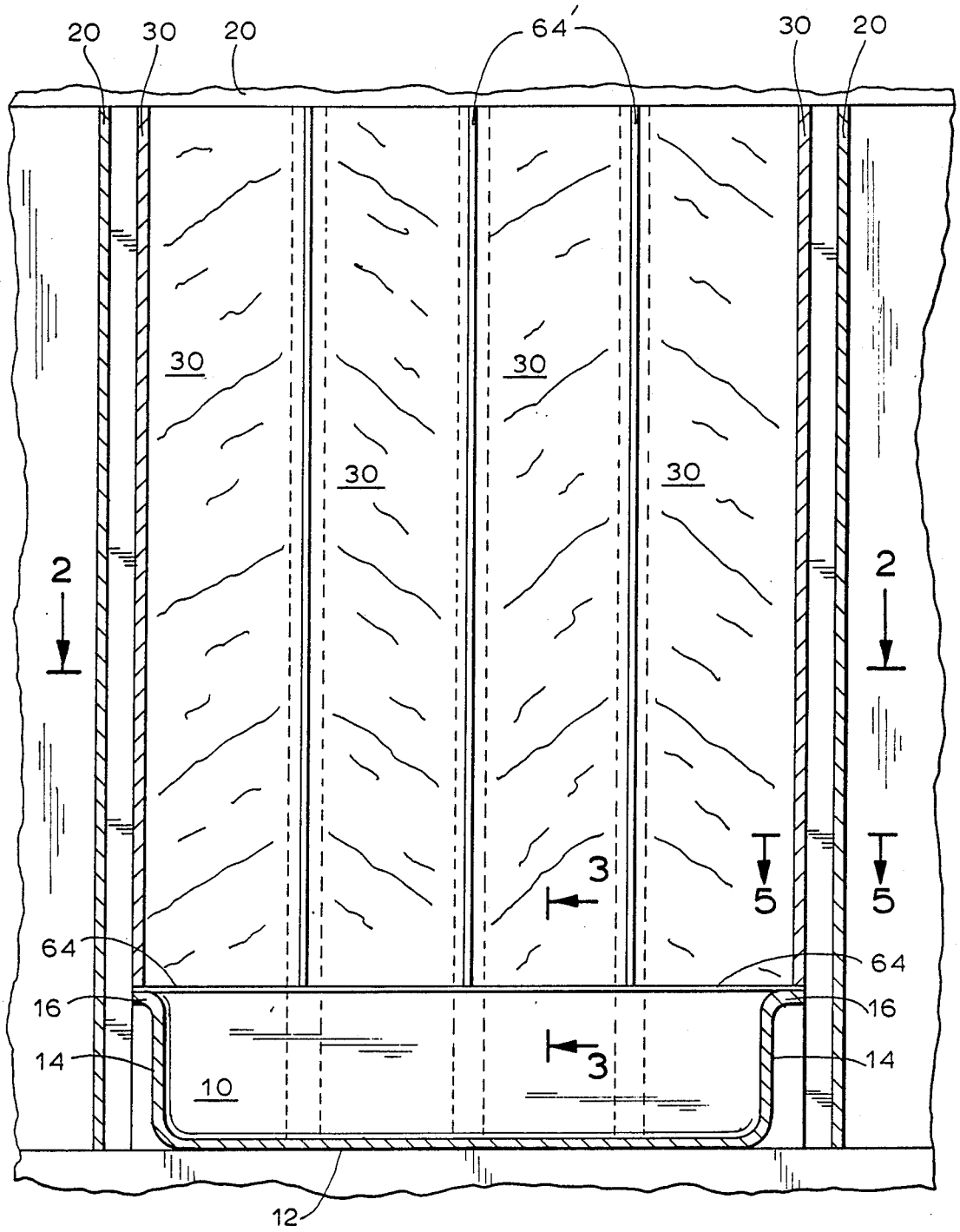
FIG. 1 is a fragmentary front elevation view, partially in cross section, of a bathtub and surround.
Figure 2:
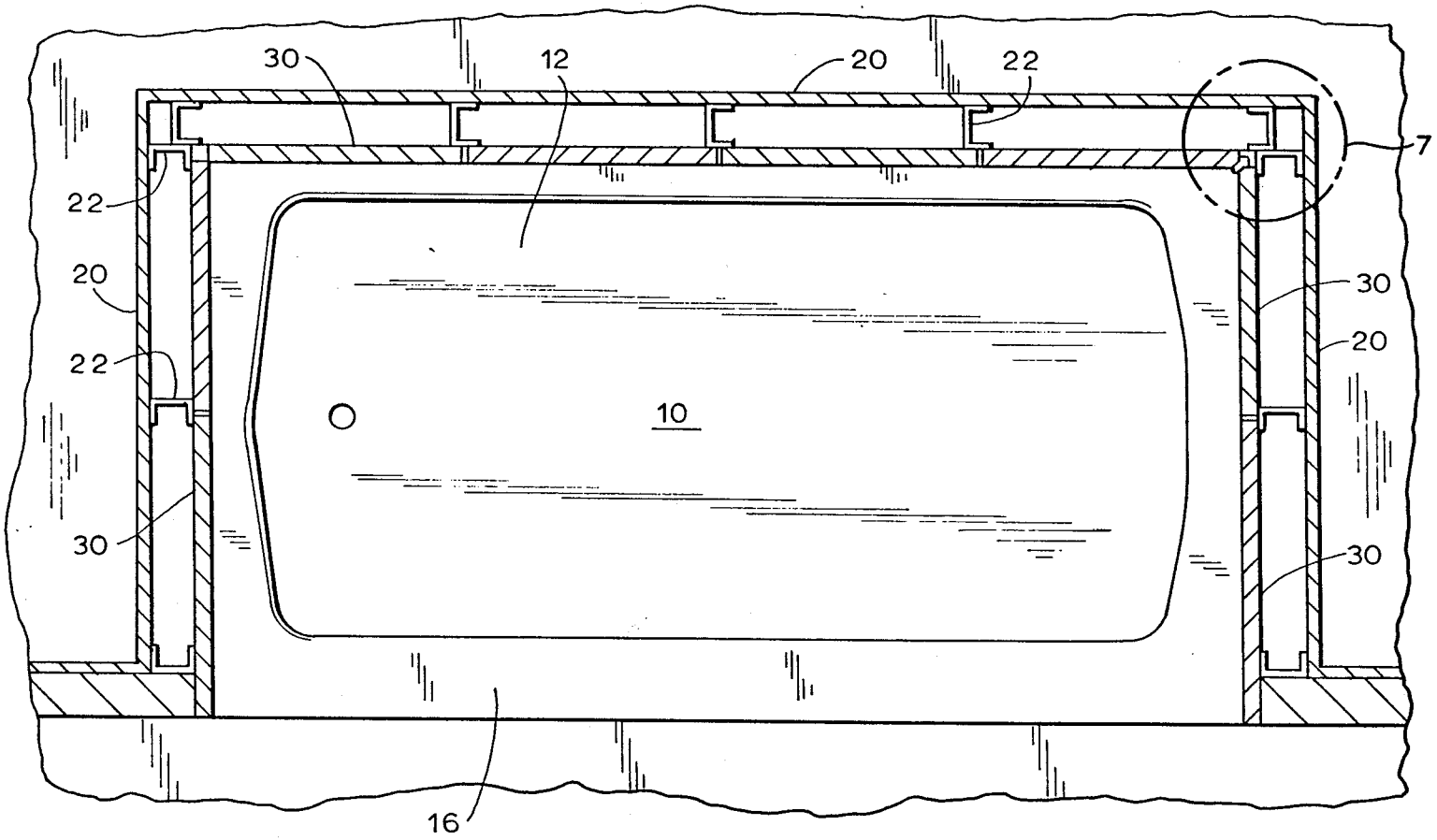
FIG. 2 is a horizontal section view taken along the line 2—2 of FIG. 1.

Referring now to the drawings, and in particular to FIGS. 1 and 2 thereof, therein illustrated is a generally rectangular bathtub generally designated by the reference numeral 10. Bathtub 10 is of conventional design having a relatively flat bottom 12, a raised sidewall 14 extending upwardly from the bottom 12 and an outwardly turned flange 16 at the free end of the sidewall 14. The free end of bathtub flanqe 16 preferably terminates in an enlarged portion or lip 18 having outwardly sloping sides.

Figure 3:
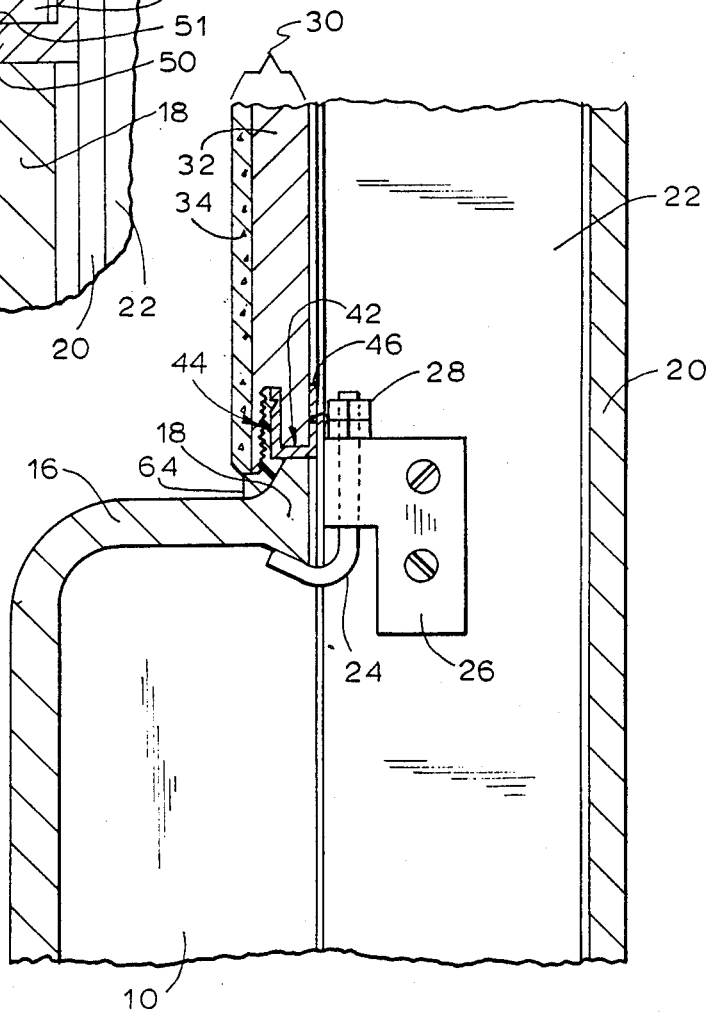
FIG. 3 is a vertical section view taken along the line 3—3 of FIG. 1 and showing details of the support fastener embodiment of the present invention.

For the purposes of illustrating the several embodiments of the present invention, bathtub 10 is illustrated as being closed in on three sides by walls 20, so that only one long side edge thereof does not face a wall (i.e. the long side edge rising out of the plane of the paper in FIG. 1). Referring now also to FIG. 3, walls 20 include metal studs 22 disposed at regular intervals along the length thereof. J-shaped bathtub supports 24 are secured to the metal studs by brackets 26 screwed, welded or otherwise affixed to metal studs 22 at regular or irregular intervals along the length thereof. As illustrated, the straight end of the bathtub support 24 is externally threaded and secured to bracket 26 by a bolt 28 while the curved lower end of bathtub support 24 extends under flange 16 an appreciable distance sufficient to provide support therefor. The bottom surface of bathtub flange lip 18 and the curved lower end of the bathtub support 24 are preferably correspondingly contoured so that the bathtub support 24 not only supports the lip 18, but also maintains it close to wall 20.

Vertically elongated panels 30 of prefabricated bathtub surround are mounted on walls 20 over bathtub flange 16, adjacent lip 18, by means of the fasteners of the present invention. While panels 30 of prefabricated bathtub surround appear to be monolithic in FIGS. 1 and 2, as more clearly illustrated in the enlarged views of FIGS. 3-8 each panel 30 is comprised of an inner substrate 32 positioned adjacent the wall 20 and an outer veneer 34 further spaced from wall 20. The substrate 32 typically provides the structural strength for the panel 30, while the veneer 34 provides an aesthetic appearance, typically a stone or tile appearance.

Various modifications of and alternatives to the elements described above are clearly applicable. For example, the bathtub need not be rectangular, but may be of any design desired; the bathtub enclosure need not be three sided, but may be one sided or two sided; and the panels of prefabricated bathtub surround may be three-ply or more-ply with a variety of different materials being utilized therein for particular aesthetic or functional features. Similarly, the bathtub support may be of a different configuration than the J-shaped member illustrated. Furthermore, it will be appreciated that the principles of the present invention, while expounded herein in the context of a bathtub surround, are equally applicable to the mounting of prefabricated panels wherever watertight seals are desired, for example, in the bathroom, kitchen, basement or pool area and in connection with fixtures of various types such as sinks, ovens, etc.

Figure 4:
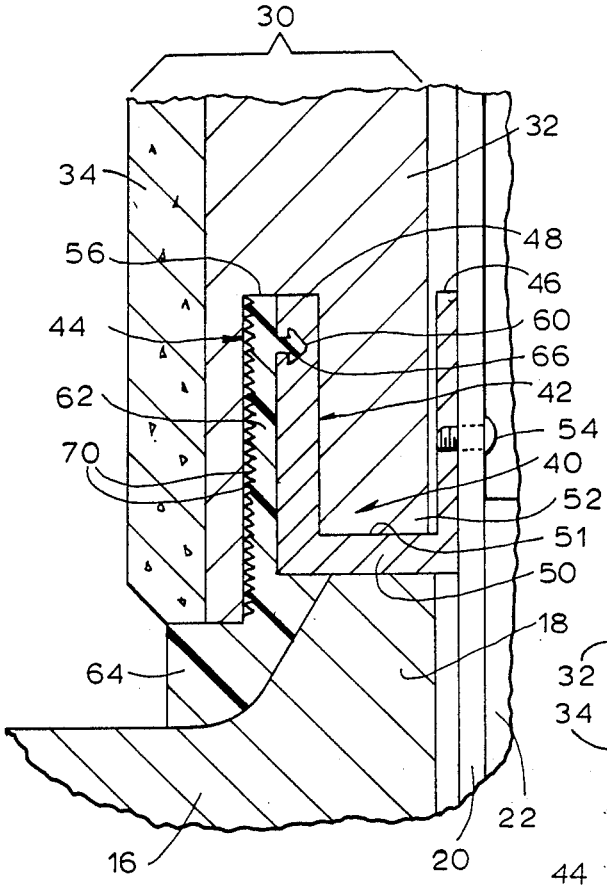
FIG. 4 is an enlarged fragmentary sectional view of a portion of FIG. 3 and showing the support fastener in greater detail.

Referring now in particular to FIGS. 3 and 4, therein illustrated is a support fastener, generally designated 40, according to a first embodiment of the present invention for mounting a prefabricated surround above a fixture, such as bathtub 10. The fastener 40 is in turn comprised of a rigid angled clip or support member, generally designated 42, and a resilient seal member, generally designated 44. The clip member 42 is substantially U-shaped and has spaced apart first and second legs 46, 48 and a base 50 connecting the legs 46, 48. The base 50 and legs 46, 48 define an open-topped chamber 51 adapted to receive a portion 52 of the surround panel 30. The first or inner leg 46 of the clip member 42 is a mounting portion adapted to be secured to the wall 20 by conventional means such as screws 54 extending through the wall 20 and first leg 46. The first leg 46 is preferably secured to the wall stud 22 so that the clip member base 50 is closely adjacent the top of the enlarged portion 16 of the bathtub 10. The second or outer leg 48 of the clip member 42 is a surround-receiving portion adapted to enter a peripheral groove 56 of the inner substrate 32 of the surround panel 30. The groove 56 opens onto the bottom of the substrate panel 30, running the entire length thereof from one side to the other, as does the second leg 48 of clip member 42.

As illustrated, the portion 52 of the inner substrate 32 which is adapted to enter into the open-topped chamber 51 defined by the clip member 42 (and in particular, the base 50 and legs 46, 48 thereof) does not extend downwardly as far as the remainder of the panel substrate 30, thereby to insure that the upper portion of the fixture 10 and optionally some of the sealing portion of the seal member 44 is concealed from view by the outer veneer 34 of the panel surround 30. For reasons which will become apparent hereinafter, the upper portion of the second leg 42, adjacent the free or upper end thereof, defines an aperture 60 extending at least partially therethrough. The clip member 42 is preferably formed of a rust-proof or rust-resistant metal such as aluminum.

The resilient seal member 44 has an elongate body portion 62 and a sealing portion 64 adapted to extend intermediate the surround panel 30 and the bathtub fixture 10 to form a watertight seal therebetween. The seal member 44 is preferably a silicone extrusion or similar resilient waterproof non-metal material. The .body portion 62 extends vertically adjacent to and substantially the length of the second leg 48 of the clip member 42. The body portion 62 defines adjacent the upper or free end thereof a transversely-extending plug 66. The plug 66 extends in the direction of the wall 20 and is received in the aperture 60 of the clip member second leg 48. Preferably, it has an arrowhead or fish-hook shape such that, once the plug 66 is inserted into the aperture 60, it is securely and tightly held therein. The front surface of the body portion 62 of seal member 44 is preferably serrated —that is, possessed of regular outwardly extending teeth 70 —and, with second leg 48, is snugly received in surround groove 56 so that the front of the body portion 62 bears against the front of the groove to form a watertight seal therebetween.

The sealing portion 64 extends transverse to the wall 20 both away from the wall beneath second leg 62 and toward the wall intermediate the bathtub flange 16 and bottom of the substrate 32. The forwardly extendly segment of the sealing portion 64 preferably extends forwardly sufficiently to cover the interface between the inner substrate 32 and outer veneer 34 of the surround 30 and to form at least a visible thin line or bead resembling the conventional grout bead. The entire seal member 44, or at least the forward portion thereof visible between the fixture 10 and surround 30, may be colored to match or complement the outer veneer 34 of the surround 30.

It will be appreciated that the plug 66 on seal member 44 and the aperture 60 in the clip member 42 provide a means for integrating the seal member 44 and clip member 42 together into a single piece for movement and positioning as a unit. The two members 42 and 44 may be separately brought to a work site and, once the configuration and dimensions of the clip member 42 (and in particular the second leg thereof) have been decided upon, the seal member 44 (and in particular the free end of the body portion 62) may be appropriately trimmed and the two members 42, 44 joined together simply by inserting the plug 66 into the aperture 60. Joinder of the two members 42, 44 could take place at the factory (that is, prior to arrival at the construction site), however, that might present difficulties in trimming of the members as necessary for appropriate dimensioning. Members 42 and 44 could be joined by other means, such as adhesive bonding. However, that may have adverse affects on the material of the seal member 44, might require additional minutes or hours at the construction site before sufficient bond strength was achieved for utilization of the composite, and might necessitate the presence of additional materials and supplies such as adhesives, possibly special adhesive dispensing units (e.g., hot melt glue applicators) and the like. By way of contrast, the plug/aperture mechanical attachment is presently preferred since it provides a simple, economical and convenient method of in situ attachment of the members. However, it is understood that circumstances may show that methods and systems, such as those referred to above, or still others, may be useful and are within the scope of the invention.

To assemble the system, the surround panel 30 is lowered into place. Surround portion 52 is easily received within the open-topped chamber 51 defined by the clip member 42, and the composite formed by the mechanically interlocked or joined clip member second leg 48 and seal member body portion 62 (and in particular the free ends thereof) is easily received by the surround groove 56. As the surround panel 30 is being lowered into place, the teeth 70 of the serrated front surface of the body portion 62 are able to deform and deflect downwardly to enable easy receipt of the composite 48/62 within the groove 56 of the surround panel 30. On the other hand, once the surround panel 30 is in place, the resiliency of the teeth 70 combine with the thicknesses of the composite 48/62 to snugly fill the groove 56, thereby to hold the surround panel 30 against transverse displacement towards and away from the wall 20 and assist in providing the watertight seal between the surround and the wall. Furthermore, withdrawal of the surround panel 30 from the fastener 40 is at least strongly resisted, by the same teeth 70 which cannot deform and flex upwardly to permit such removal because they are blocked by the upper portion of the groove 56. Thus, the serrated front surface of the fastener 40 facilitates receipt of the fastener 40 by the surround panel 30, resists movement of the panel 30 transverse to the wall 20, and resists upward retreat of the panel 30 from the fastener 40.

Figure 6:
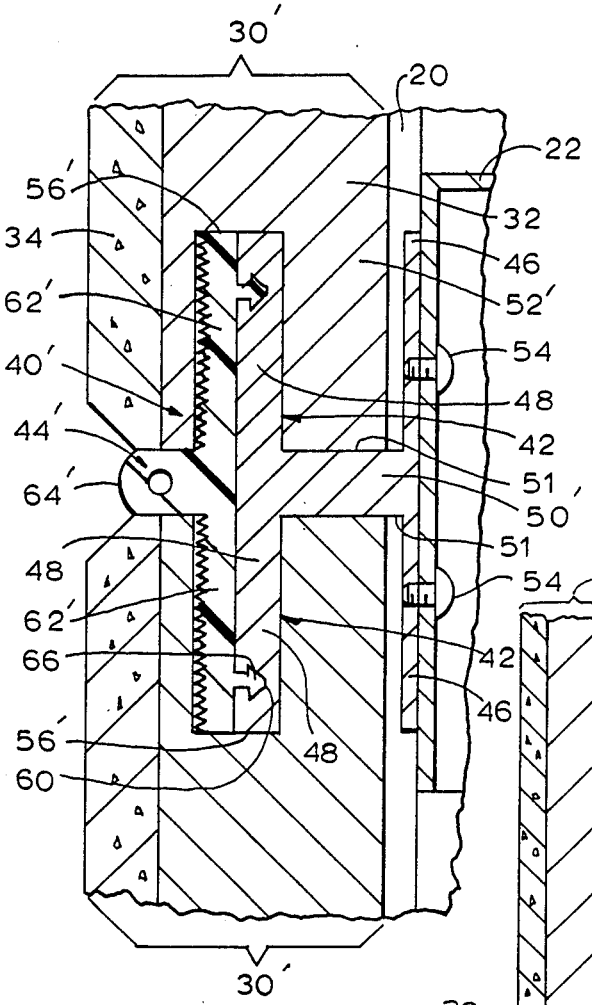
FIG. 6 is an enlarged fragmentary sectional view of a portion of FIG. 5 and showing the butt joint fastener in greater detail.
Figure 5:
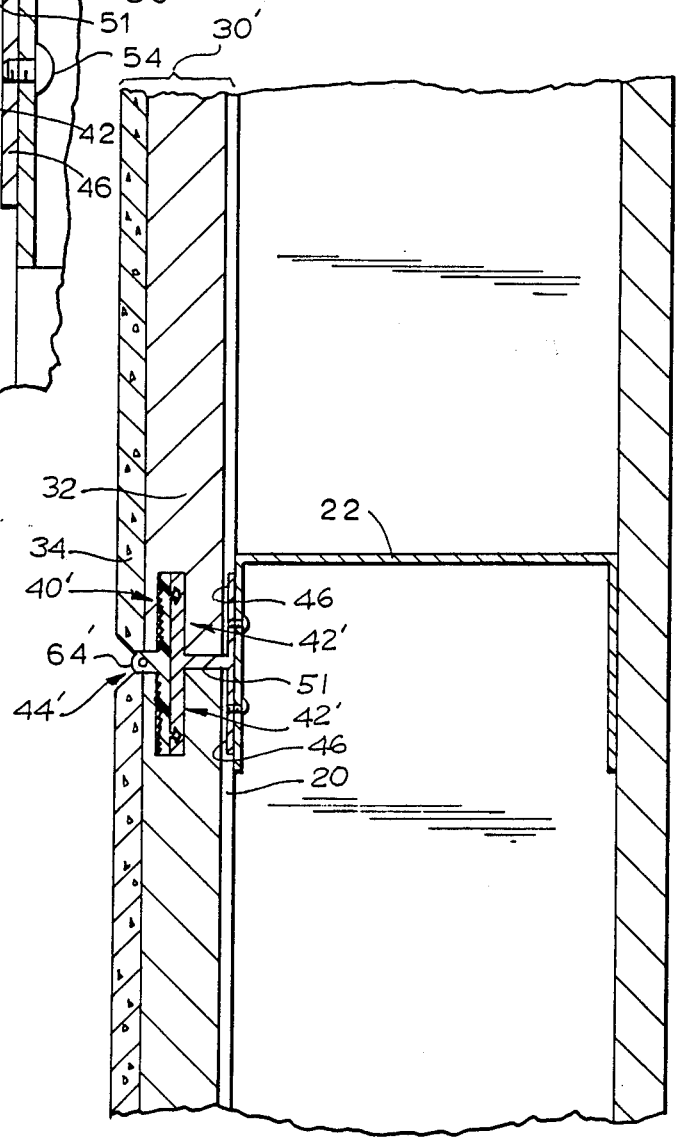
FIG. 5 is a horizontal sectional view taken along the line 5—5 of FIG. 1 and showing details of the butt joint fastener embodiment of the present invention.

Referring now to FIGS. 5 and 6 in particular, therein illustrated is a butt joint fastener generally designated 40' according to a second embodiment of the present invention for mounting a horizontally aligned and laterally adjacent pair of prefabricated surround panels on a wall. Structures in the second embodiment (FIGS. 5 and 6) identical in both function and configuration to the structures of the first embodiment (FIGS. 3 and 4) are identified by like numerals, while structures performing like functions but possessed of different configurations are identified by corresponding numerals primed. The surround panels 30' include laterally-opening peripheral grooves 56' on each lateral side (extending the height of the surround panels 30') and may be the same as surround panels 30 —i.e., also include a bottom groove 56.

The fastener 40' of the second embodiment is generally similar to a pair of fasteners 40 of the first embodiment, joined base to base and rotated 90° . Thus, the clip or support member 42' extends the full height of the surround panels 30' and is in cross section substantially an H-shape defining two oppositely facing U-shaped members (each like the clip member 42) sharing a common base 50'.

More particularly, the clip member 42' is defined by a pair of horizontally aligned and laterally adjacent mounting portions or first legs 46 adapted to be secured to the wall 20, a pair of horizontally aligned and laterally adjacent surround-receiving portions or second legs 48 adapted to enter the peripheral grooves 56' of different ones of the surround panels 30', and a base 50' connecting the first legs 46 and second legs 48. The base 50', one of the first legs 46 and one of the second legs 48 to one side of the base 50' define an open-ended chamber 51 to receive a portion 52' of one of the surround panels 30' and the base 50' and the other of the first legs 46 and second legs 48 to the other side of the base 50' define another open-ended chamber 51 to receive a portion 52' of the other surround panel 30'. Accordingly, the clip member 42' defines a pair of laterally opening chambers 51, each of which receives the full height of a side portion 52' of a different surround panel 30'.

The seal member 44' is T-shaped with an elongate body portion 62' and a sealing portion 64'. The body portion 62' extends substantially the length of, and in contact with, the adjacent side of the second legs 48' of clip member 42', the free ends of the body portion 62' and the adjacent second legs 62' being adapted to enter the peripheral grooves 56' of different surround panels 30' of the pair. The sealing portion 64' extends transversely to the body portion 62', generally in the plane of the common base 50', between a pair of laterally adjacent surround panels 30' to form a watertight seal therebetween.

Preferably, although not necessarily, the screws 54 joining the fastener 40' to the wall 20 pass through the metal stud 22 for additional support.

Figure 8:
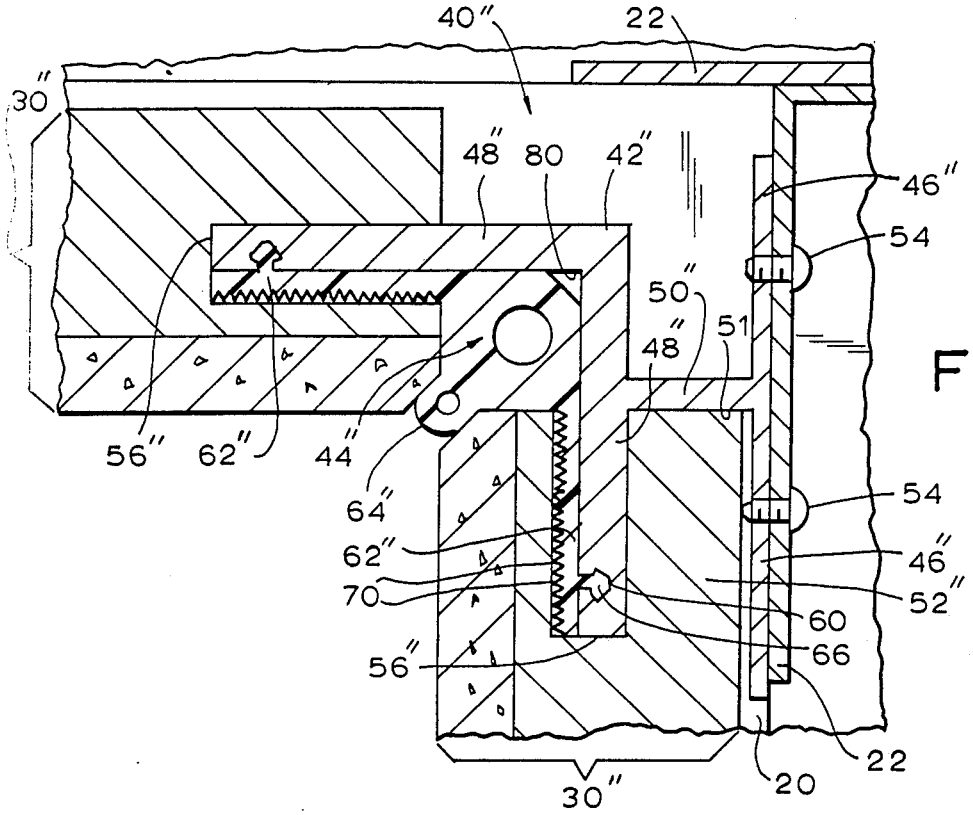
FIG. 8 is an enlarged fragmentary sectional view of a portion of FIG. 7 showing the corner fastener in greater detail.
Figure 7:
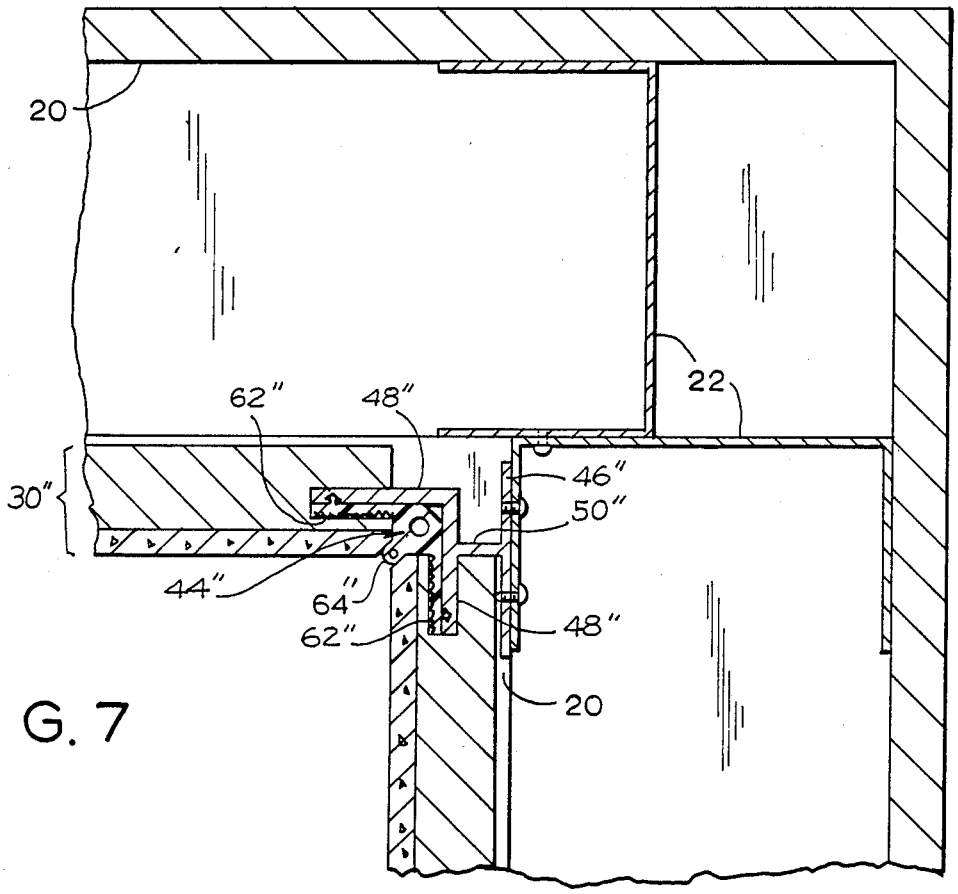
FIG. 7 is an enlarged sectional view of the portion of FIG. 2 within the circle identified as FIG. 7 and showing details of the corner fastener embodiment of the present invention.

Referring now in particular to FIGS. 7 and 8, therein illustrated is a corner joint fastener generally designated 40'' according to a third embodiment of the present invention for mounting a pair of prefabricated surround panels on the walls of a corner, with the surround panels being mutually disposed at substantially a right angle. Structures in the third embodiment (FIGS. 7 and 8) identical in both function and configuration to structures of the first embodiment (FIGS. 3 and 4) are designated by like numerals, while structures performing like functions but possessed of different configurations are identified by the corresponding numerals with a double prime. The surround panels 30'' and peripheral grooves 56'' thereof of the third embodiment are similar to the surround panels 30' and peripheral grooves 56' thereof of the second embodiment.

The fastener 40'' has a clip or support member 42'' which extends the full height of the surround panels 30'' and is in cross section generally L-shaped with respect to its two second legs or surround-receiving portions 48'', the free ends of which enter the peripheral grooves 56'' of different surround panels 30''. The clip member additionally includes a first leg or mounting portion 46'' and base 50'' which cooperate (as in the other embodiments) with one of the second legs 48'' to define an open-ended chamber 51 to receive a portion 52'' of one of the surround panels 30''. The first leg 46'' may extend to both the sides of the base 50'' and be secured to metal stud 22 and wall 20 by screws 54.

The seal member 44'' has an elongate body portion 62'' and a sealing portion 64''. The body portion 62'' is substantially an L-shape in cross section and extends substantially the length of, and in contact with, an adjacent side of the second legs 48''. The free ends of the body portion 62'' and the second legs 48'' are adapted to enter the peripheral grooves 56'' of different surround panels 30'' of the pair. The sealing portion 64'' is adapted to extend diagonally outwardly from the vertex 80 of the body portion 62" between the pair of surround panels 30" to form a watertight seal therebetween. The back surface of the seal member 44" follows the contours of the front surface of the clip member 42" (that is, the second legs 48" thereof).

It will be appreciated that in the corner joint fastener, only a single open-ended chamber 51 is formed for receipt of a portion 52" of a surround panel 30". The other surround panel 30" is engaged by the free ends of the other second leg or surround-receiving portion 48" and the free end of the body portion 62", but there is no corresponding open-ended chamber 51 to receive a portion of the substrate.

In constructing a surround, a surround panel already mounted on a support fastener 40 (as described hereinabove) is slid horizontally relative thereto until the groove in the forward longitudinal side of the surround panel is entered by and receives the combined free ends of the body portion of the seal member and the surround-receiving portion of the support member. (It will be appreciated that this body portion and surround-receiving portion may be portions of a butt joint fastener 40' or a wall corner fastener 40".) Next, a fastener is mounted on the wall adjacent the other or trailing longitudinal side of the mounted surround panel, with the combined free ends of the body portion and the surround-receiving portion on the leading side thereof entering the trailing longitudinal groove of the mounted support panel. (Again this fastener may be a butt joint fastener 40' or a corner fastener 40".) The process may then be repeated, mounting one surround panel and then another fastener, one after the other, until the desired length of the wall is covered by surround panels. The flexibility of the seal member of the fastener facilitates the mounting of the support panels on the fasteners as well as the relative motions of the support panels and the fasteners.

Notwithstanding the above noted differences in configuration and detail necessary in order to accommodate the needs of particular applications, the principles of the present invention are the same in each embodiment. Accordingly, whether one considers the first embodiment which is intended to support a prefabricated surround above a fixture, the second embodiment which is intended to mount a horizontally aligned pair of prefabricated surrounds in adjacent lateral relationship or the third embodiment which is intended to mount a pair of prefabricated surrounds in a corner with the surrounds being mutually disposed at a right angle, in each instance the basic principles of the present invention will apply.

To summarize, the present invention provides a plug and aperture arrangement which allows the seal member and clip member to be easily joined without the use of tools or adhesives into a single piece in situ so that the sealing element does not have to be separately positioned and maintained during mounting of the surround. The mechanical interlock of the two members adjacent the free ends thereof for movement as a unit prevents the resilient seal member from folding over or otherwise becoming displaced during mounting of the surround. The serrated front surface of the body portion of the seal member snugly abuts the front of the surround panel groove to facilitate mounting of the surround panel, resist transverse displacement of the surround panel towards and away from the wall, and resist withdrawal of the surround panel from the fastener. The fastener is easy and economical to manufacture and use.

Now that the preferred embodiments of the present invention have been shown and described in detail, various modifications and improvements thereon will become readily apparent to those skilled in the art. Accordingly, the appended claims should be construed broadly and in a manner consistent with the spirit and scope of the invention herein.

We claim:

1. In combination:
(A) a prefabricated surround panel defining at the base thereof intermediate the front and back thereof a peripherally-opening groove;
(B) a fixture disposed below said panel; and
(C) a watertight fastener for mounting said surround panel on a wall comprising:
(i) a rigid support member having a mounting portion and a surround-receiving portion, said mounting portion being secured to the wall and said surround-receiving portion being within said peripheral groove of said surround panel; and
(ii) A unitary one piece non-metal resilient seal member having an elongate body portion and at one end a sealing portion, said body portion and said surround-receiving portion extending into said peripheral groove of said surround panel, and said sealing portion extending intermediate said surround panel and said fixture to form a watertight seal therebetween.

2. The combination of claim 1 wherein said support member defines an open-top chamber adapted to receive a portion of the surround panel.

3. The combination of claim 1 wherein said sealing portion extends transverse to and away from the wall when said fastener mounts said surround panel on the wall.

4. The combination of claim 3 wherein said sealing portion extends transverse to and toward the wall.

5. The combination of claim 1 wherein said body portion of said seal member has a first surface abutting a surface of said surround-receiving portion and a serrated second surface abutting a surface of said peripheral groove of said surround panel.

6. The combination of claim 1 wherein said body portion of said seal member has a serrated front surface which abuts a front surface of said peripheral groove of said surround panel to form a watertight seal therebetween.

7. The combination of claim 1 wherein said surround-receiving portion of said support member and said body portion of said seal member define interlocking means for joining said two members for movement as a unit.

8. The combination of claim 7 wherein one of said surround-receiving portion and said body portion defines adjacent the free end thereof an aperture extending at least partially therethrough, and the other of said surround-receiving portion and said body portion defines adjacent the free end thereof a transversely-extending plug resiliently retained in said aperture, said plug and said aperture being configured and dimensioned to interlock.

9. The combination of claim 8 wherein said surround-receiving portion defines adjacent the free end thereof an aperture extending at least partially therethrough, and said body portion defines a transversely-extending plug resiliently retained in said aperture.

10. The combination of claim 1 wherein said seal member is polymeric.

* * * * *